US010109222B1

(12) United States Patent
Nuss

(10) Patent No.: US 10,109,222 B1
(45) Date of Patent: Oct. 23, 2018

(54) ILLUMINATED RETRACTABLE BANNER DISPLAY

(71) Applicant: SIGN-ZONE, INC., Brooklyn Center, MN (US)

(72) Inventor: Jenn Nuss, Ramsey, MN (US)

( * ) Notice: Subject to any disclaimer, the term of this patent is extended or adjusted under 35 U.S.C. 154(b) by 0 days.

(21) Appl. No.: 15/917,903

(22) Filed: Mar. 12, 2018

(51) Int. Cl.
*G09F 13/18* (2006.01)
*G09F 17/00* (2006.01)

(52) U.S. Cl.
CPC ..... *G09F 13/18* (2013.01); *G09F 17/00* (2013.01); *G09F 2013/1881* (2013.01)

(58) Field of Classification Search
CPC ..... G09F 13/02; G09F 17/00; G09F 11/21
See application file for complete search history.

(56) References Cited

U.S. PATENT DOCUMENTS

2002/0050083 A1* 5/2002 Zarelius ..... G09F 11/18 40/514
2002/0121034 A1* 9/2002 Schmitt ..... G09F 15/0025 40/604
2006/0130382 A1* 6/2006 Howell ..... G09F 13/02 40/607.09
2006/0274521 A1* 12/2006 Ullrich ..... G09F 7/22 362/159
2008/0005945 A1* 1/2008 Fritsche ..... G09F 11/21 40/603
2008/0105797 A1* 5/2008 Fritsche ..... G09F 15/0025 248/161
2009/0056184 A1* 3/2009 Fritsche ..... G09F 15/0025 40/604
2009/0316391 A1* 12/2009 Huang ..... A47F 3/001 362/133
2010/0058634 A1* 3/2010 Elliott ..... G09F 15/0025 40/606.12
2010/0146832 A1* 6/2010 Gimpel ..... G09F 11/21 40/604
2010/0180481 A1* 7/2010 Parizek ..... G09F 11/30 40/610
2010/0299983 A1* 12/2010 Wang ..... G09F 13/02 40/553
2014/0053436 A1* 2/2014 English ..... G09F 15/0025 40/541

* cited by examiner

*Primary Examiner* — Gary C Hoge
(74) *Attorney, Agent, or Firm* — Dave Alan Lingbeck

(57) ABSTRACT

An illuminated retractable banner display assembly for displaying and illuminating a banner. The illuminated retractable banner display assembly includes an elongated base member; a first light-emitting assembly coupled to the base member; a banner support assembly detachably attached to the base member and adapted to display a banner upright relative to the base member; and a second light-emitting assembly coupled to the banner support assembly.

14 Claims, 3 Drawing Sheets

ILLUMINATED RETRACTABLE BANNER DISPLAY

BACKGROUND OF THE INVENTION

Field of the Invention

The present invention relates to banner support devices and more particularly pertains to a new illuminated retractable banner display assemblyfor displaying and illuminating a banner.

Description of the Prior Art

The use of banner support devices is known in the prior art. More specifically, banner support devices heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a base and a post operably coupled to the base and extending upwardly therefrom, and a support member operably coupleable with the post to support the banner in an upright display mode and to convert the banner to a curved configuration. Another prior art includes a retractable banner stand having a banner, a support base, a mast, a retracting mechanism, and a means for imparting a curvature in the horizontal plane on the banner. While these devices fulfill their respective, particular objectives and requirements, the aforementioned patents do not disclose a new illuminated retractable banner display.

SUMMARY OF THE INVENTION

The general purpose of the present invention, which will be described subsequently in greater detail, is to provide a new illuminated retractable banner display assembly which has many of the advantages of the banner support devices mentioned heretofore and many novel features that result in a new illuminated retractable banner display assemblywhich is not anticipated, rendered obvious, suggested, or even implied by any of the prior art banner support devices, either alone or in any combination thereof. The present invention includes an elongated base member; a first light-emitting assembly coupled to the base member; a banner support assembly detachably attached to the base member and adapted to display a banner upright relative to the base member; and a second light- emitting assembly coupled to the banner support assembly. None of the prior art includes the combination of the elements of the present invention.

There has thus been outlined, rather broadly, the more important features of the illuminated retractable banner display assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is art object of the present invention to provide a new illuminated retractable banner display assembly which has many of the advantages of the banner support devices mentioned heretofore and many novel features that result in a new illuminated retractable banner display assembly which is not anticipated, rendered obvious, suggested, or even implied by any of the prior art banner support devices, either alone or in any combination thereof.

Still another object of the present invention is to provide a new illuminated retractable banner display assembly for displaying and illuminating a banner.

Still yet another object of the present invention is to provide a new illuminated retractable banner display assembly that includes detachable light rails on the base and on the top of the banner.

Even still another object of the present invention is to provide a new illuminated retractable banner display assembly that allows the user to easily detach the light rails and easily attach the light rails to other display assemblies.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
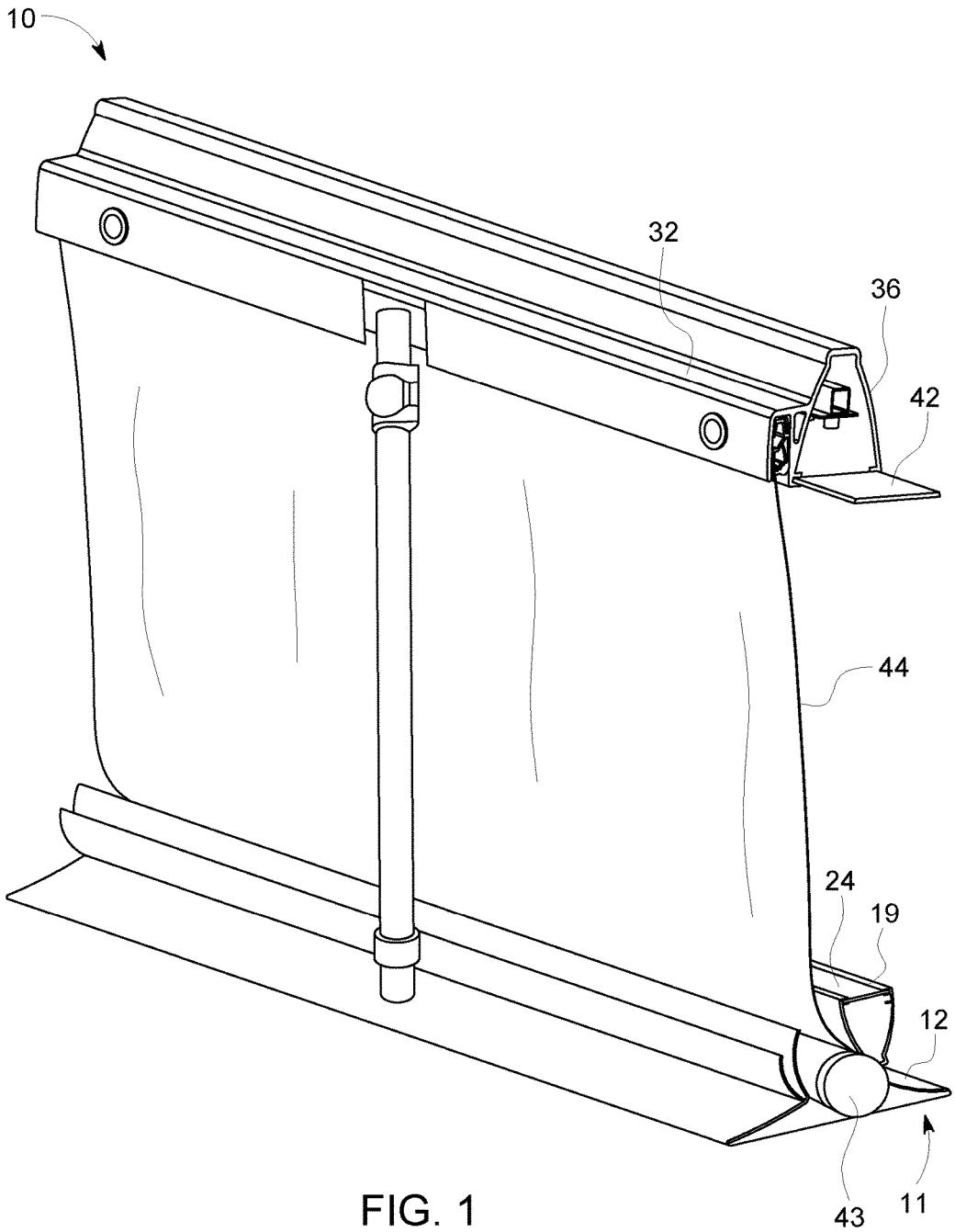
FIG. 1 is a perspective view of a new illuminated retractable banner display assembly according to the present invention.
Figure 2:
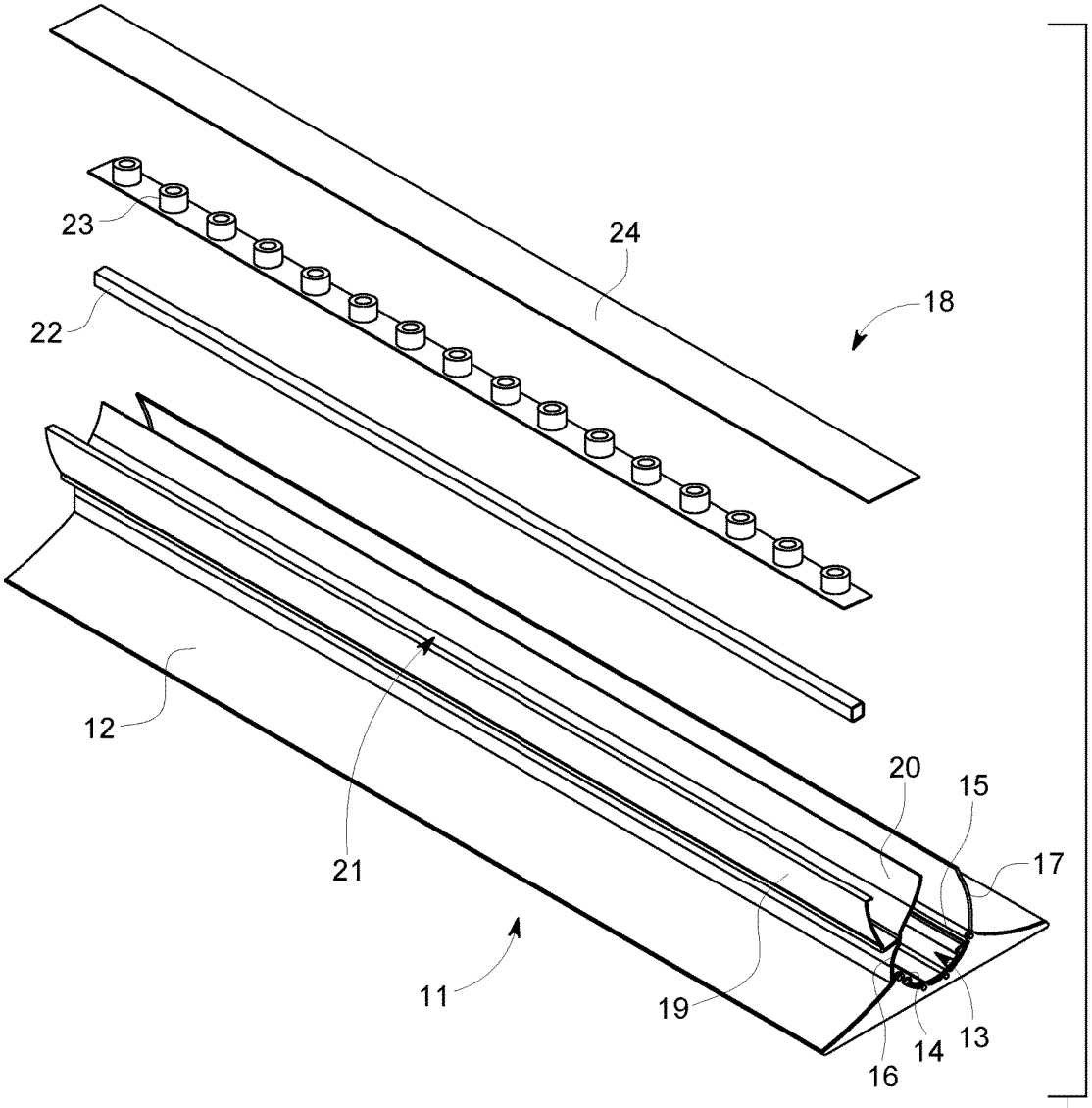
FIG. 2 is an exploded bottom perspective view of the base member and the first light-emitting assembly of the present invention.
Figure 3:
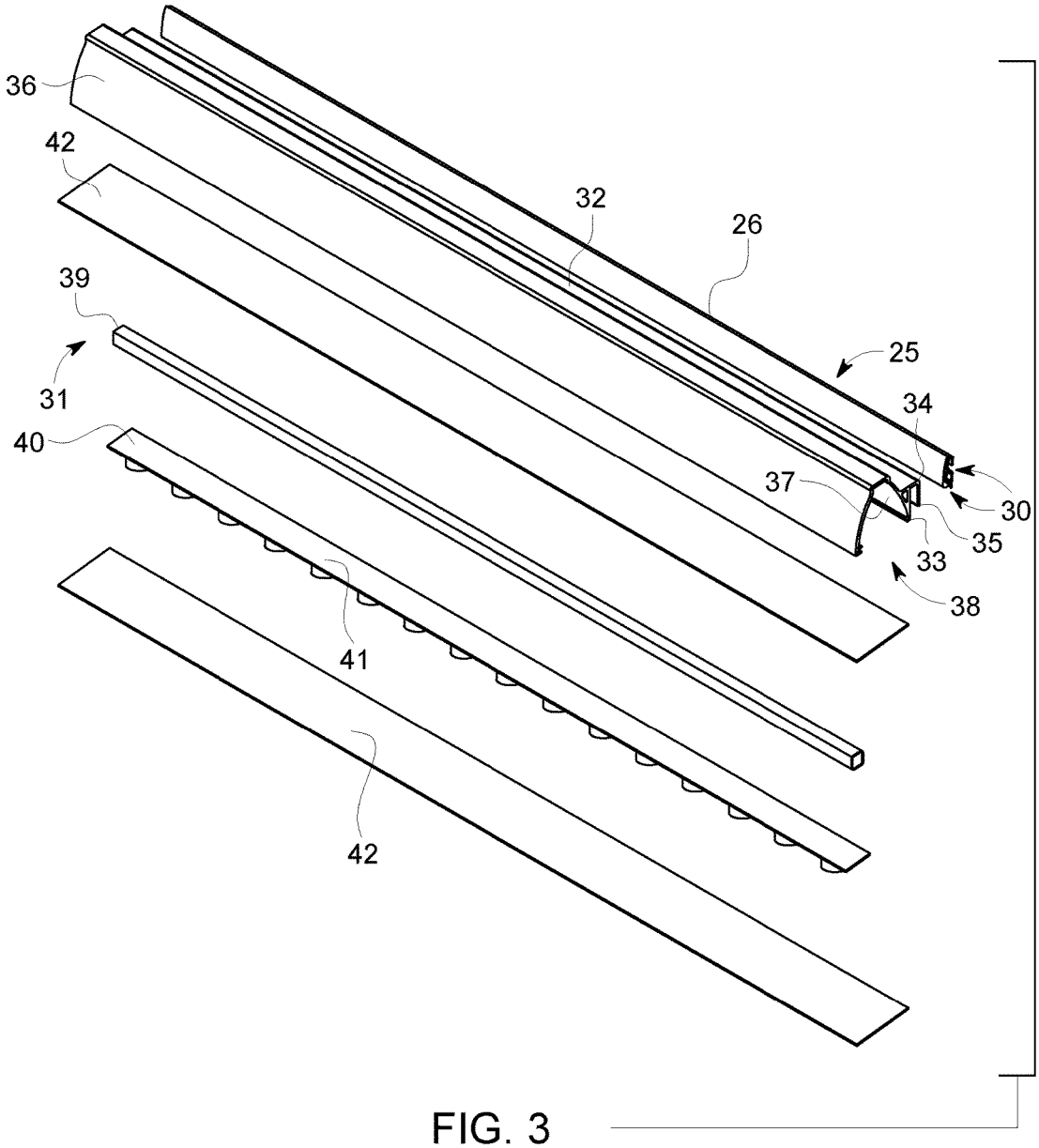
FIG. 3 is an exploded perspective view of the banner support assembly and the second light-emitting assembly of the present invention.

With reference now to the drawings, and in particular to FIGS. 1 through 3 thereof, a new illuminated retractable banner display assembly embodying the principles and concepts of the present invention and generally designated by the reference numeral 10 will be described.

As best illustrated in FIGS. 1 through 3, the illuminated retractable banner display assembly 10 generally comprises an elongated base member 11; a first light-emitting assembly 18 conventionally coupled to the base member 11; a banner support assembly 25 detachably attached to the base member 11 and adapted to display a banner 44 upright relative to the base member 11; and a second light-emitting assembly 31 removably mounted to the banner support assembly 25.

The elongated base member 11 has a top side 12 and a channel 13 formed in the top side 12 and adapted to support a banner cartridge 43 containing the banner 44. The channel 13 has opposed longitudinal edges 14,15 with plate-like guides 16,17 each conventionally disposed upon and along a length of a respective longitudinal edge 14,15 of the channel 13. The plate-like guides 16,17 are laterally curved towards one another.

The first light-emitting assembly 18 includes an elongated first housing 19 having an open top 21. The elongated first housing 19 has a side wall 20 which is conventionally attached to an outer side of one of the plate-like guides 16. The first light-emitting assembly 18 also includes an elongated first bracket 22 conventionally disposed in the first housing 19 and extending a length thereof, and further includes a first strip of light-emitting members 23 conventionally disposed upon and extending along a length of the first bracket 22 and adapted to be in communication with a power source (not shown). The first light-emitting assembly 18 also includes a first transparent cover 24 conventionally disposed upon the first strip of light-emitting members 23 with the strip of light-emitting members 23 arranged to shine light upwardly through the open top 21 of the first housing 19 and upon the upright banner 44.

The banner support assembly 25 includes a pole 26 having, a bottom end 27 removably and conventionally mounted upon the base member 11 and also having a top end 28, and also includes an elongated banner bracket 29 removably and conventionally fastened to the top end 28 of the pole 26 and adapted to retain a top portion 45 of the banner 44. The elongated banner bracket 29 has a sinusoidal lateral cross section forming longitudinal grooves 30 with one of the longitudinal grooves 30 adapted to receive and retain the top portion 45 of the banner 44 therein.

The second light-emitting assembly 31 includes a rail 32 having side walls 33,34 which are spaced apart and also includes an elongated second housing 36 conventionally attached to the rail 32 and having an open bottom 38. The second housing 36 has a side wall 37 which is conventionally attached to one of the side walls 33 of the rail 32. One of the side walls 33 of the rail 32 has a bottom edge 46 with a lip 35 integrally disposed along the bottom edge 46 thereof and disposed inwardly of the rail 32 in between the space between the side walls 33,34 of the rail 32. The rail 32 is removably disposed upon and about the banner bracket 29 with the lip 35 engaging the banner bracket 29 for mounting the second light-emitting assembly 31 upon the banner bracket 29. The second light-emitting assembly 31 also includes an elongated second bracket 39 conventionally disposed in the second housing 36 and extending a length thereof, and further includes a second strip of light-emitting members 40 having a top side 41 conventionally attached to a bottom 47 of and extending along a length of the second bracket 39 and adapted to be in communication with a power source. The second light-emitting assembly 31 also includes a second transparent cover 42 conventionally attached to a bottom side 48 of the second strip of light-emitting members 40 and with the second strip of light-emitting members 40 arranged to shine light downwardly through the open bottom 38 of the second housing 36 and upon the upright banner 44.

In use, the banner support assembly 25 is conventionally mounted upon the base member 12 with the banner 44 extending upright from the base member 12. The second light-emitting assembly 32 is removably mounted upon the banner support assembly 25. The rail 32 is slid upon the banner bracket 29. The first and second light-emitting assemblies 18,31 are energized to shine light upon the banner 44.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the illuminated retractable banner display. Further, since numerous modifications and changes will readily occur to those skilled in the art, it is not desired to limit the invention to the exact construction and operation shown and described, and accordingly, all suitable modifications and equivalents may be resorted to, falling within the scope of the invention,

I claim:

1. An illuminated retractable banner display assembly comprising:

an elongated base member, wherein the elongated base member has a top side and a channel formed in the top side and adapted to support a banner cartridge containing the banner, wherein the channel has opposed longitudinal edges with plate-like guides each disposed upon and along a length of a respective said longitudinal edge of the channel;

a first light-emitting assembly coupled to the base member;

a banner support assembly detachably attached to the base member and adapted to display a banner upright relative to the base member; and a second light-emitting assembly removably mounted to the banner support assembly.

2. The illuminated retractable banner display assembly as described in claim 1, wherein the plate-like guides are laterally curved towards one another.

3. The illuminated retractable banner display assembly as described in claim 1, wherein the first light-emitting assembly includes an elongated first housing having an open top.

4. The illuminated retractable banner display assembly as described in claim 3, wherein the elongated first housing has a side wall which is attached to an outer side of one of the plate-like guides.

5. The illuminated retractable banner display assembly as described in claim 3, wherein the first light-emitting assembly also includes an elongated first bracket disposed in the first housing and extending a length thereof, and further includes a first strip of light-emitting members disposed upon and extending along a length of the first bracket and adapted to be in communication with a power source.

6. The illuminated retractable banner display assembly as described in claim 5, wherein the first light-emitting assembly also includes a first transparent cover disposed upon the first strip of light-emitting members with the first strip of light-emitting members arranged to shine light upwardly through the open top of the housing and upon the upright banner.

7. An Illuminated retractable banner display assembly comprising:

an elongated base member;

a first light-emitting assembly coupled to the base member;

a banner support assembly detachably attached to the base member and adapted to display a banner upright relative to the base member, wherein the banner support assembly includes a pole having a bottom end removably mounted upon the base member and also having a top end, and also includes an elongated banner bracket removably fastened to the top end of the pole and adapted to retain a top portion of the banner, wherein the elongated banner bracket has a sinusoidal lateral cross section forming longitudinal grooves with one of the longitudinal grooves adapted to receive and retain the top portion of the banner therein; and a second light-emitting assembly removably mounted to the banner support assembly.

8. The illuminated retractable banner display assembly as described in claim 7, wherein the second light-emitting assembly includes a rail having side walls which are spaced apart and also includes an elongated second housing attached to the rail and having an open bottom.

9. The illuminated retractable banner display assembly as described in claim 8, wherein the second housing has a side wall which is attached to one of the side walls of the rail.

10. The illuminated retractable banner display assembly as described in claim 8, wherein one of the side walls of the rail has a bottom edge with a lip disposed along the bottom edge thereof and disposed inwardly of the rail in between the space between the side walls of the rail, wherein the rail, is removably disposed upon and about the banner bracket with the lip engaging the banner bracket for mounting the second light-emitting assembly upon the banner bracket.

11. The illuminated retractable banner display assembly as described in claim 8, wherein the second light-emitting assembly also includes an elongated second bracket disposed in the second housing and extending a length thereof, and further includes a second strip of light-emitting members having a top side attached to a bottom of and extending along a length of the second bracket and adapted to be in communication with a power source.

12. The illuminated retractable banner display assembly as described in claim 11, wherein the second light-emitting assembly also includes a second transparent cover attached to the bottom side of the second strip of light-emitting members and with the second strip of light-emitting members arranged to shine light downwardly through the open bottom of the housing and upon the upright banner.

13. A method of using an illuminated retractable banner display assembly comprising:

providing a base member, a first light-emitting assembly mounted to the base member, a banner support assembly including a banner bracket, and a second light-emitting assembly, wherein the second light-emitting assembly includes a rail;

mounting the banner support assembly upon the base member and extending a banner upright from the base member;

removably mounting the second light-emitting assembly upon the banner support assembly; and energizing the first and second light-emitting assemblies to shine light upon the banner.

14. The method of using the illuminated retractable banner display assembly as described in claim 13 further including sliding the rail upon the banner bracket.

* * * * *